US007963826B2

(12) United States Patent
Nangoy et al.

(10) Patent No.: US 7,963,826 B2
(45) Date of Patent: Jun. 21, 2011

(54) APPARATUS AND METHODS FOR CONDITIONING A POLISHING PAD

(75) Inventors: Roy C. Nangoy, Santa Clara, CA (US); Shou-Sung Chang, Stanford, CA (US); Donald J. K. Olgado, Palo Alto, CA (US); Hung Chih Chen, Sunnyvale, CA (US); Gerald John Alonzo, Los Gatos, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 12/636,326

(22) Filed: Dec. 11, 2009

(65) Prior Publication Data

US 2010/0093263 A1 Apr. 15, 2010

Related U.S. Application Data

(62) Division of application No. 12/245,758, filed on Oct. 5, 2008, now abandoned, which is a division of application No. 11/684,969, filed on Mar. 12, 2007, now abandoned.

(60) Provisional application No. 60/782,133, filed on Mar. 13, 2006.

(51) Int. Cl.
*B24B 1/00* (2006.01)

(52) U.S. Cl. ..... 451/56; 451/443

(58) Field of Classification Search ..... 451/56, 451/443

See application file for complete search history.

(56) References Cited

U.S. PATENT DOCUMENTS

| | | | | |
|---|---|---|---|---|
| 3,819,991 | A | 6/1974 | Weigele et al. | |
| 4,382,308 | A | 5/1983 | Curcio | |
| 4,987,700 | A | 1/1991 | Westerman et al. | |
| 5,475,889 | A | 12/1995 | Thrasher et al. | |
| 5,486,129 | A | 1/1996 | Sandhu et al. | |
| 5,700,180 | A | 12/1997 | Sandhu et al. | |
| 5,738,574 | A | 4/1998 | Tolles et al. | |
| 5,743,784 | A | 4/1998 | Birang et al. | |
| 5,846,882 | A | 12/1998 | Birang | |
| 5,875,507 | A | 3/1999 | Stephens et al. | |
| 5,901,400 | A | 5/1999 | Fulop | |
| 5,943,726 | A | 8/1999 | Eitoku et al. | |
| 6,059,888 | A | 5/2000 | Hillman | |
| 6,070,284 | A | 6/2000 | Garcia et al. | |
| 6,123,607 | A * | 9/2000 | Ravkin et al. | 451/56 |
| 6,143,089 | A | 11/2000 | Stephens et al. | |

(Continued)

FOREIGN PATENT DOCUMENTS

CA 2 248 459 3/2000

(Continued)

OTHER PUBLICATIONS

Final Office Action of U.S. Appl. No. 12/245,758 Mailed Feb. 16, 2010.

(Continued)

*Primary Examiner* — Maurina Rachuba
(74) *Attorney, Agent, or Firm* — Dugan & Dugan, PC

(57) ABSTRACT

Apparatus and methods for conditioning a polishing pad include an arm adapted to support a conditioning disk; a drive mechanism coupled to the arm; and a flexible coupling between the drive mechanism and the conditioning disk adapted to allow the conditioning disk to tilt while transmitting rotary motion from the drive mechanism to the conditioning disk. Numerous other aspects are disclosed.

15 Claims, 11 Drawing Sheets

U.S. PATENT DOCUMENTS

| | | | | |
|---|---|---|---|---|
| 6,217,430 | B1 * | 4/2001 | Koga et al. | 451/444 |
| 6,230,753 | B1 | 5/2001 | Jones et al. | |
| 6,254,688 | B1 | 7/2001 | Kobayashi et al. | |
| 6,269,510 | B1 | 8/2001 | Beardsley et al. | |
| 6,306,008 | B1 * | 10/2001 | Moore | 451/5 |
| 6,345,404 | B1 | 2/2002 | Stephens et al. | |
| 6,347,981 | B1 | 2/2002 | Holzapfel | |
| 6,350,184 | B1 | 2/2002 | Holzapfel | |
| 6,352,596 | B2 | 3/2002 | Beardsley et al. | |
| 6,371,838 | B1 | 4/2002 | Holzapfel | |
| 6,409,580 | B1 | 6/2002 | Lougher et al. | |
| 6,425,158 | B2 | 7/2002 | Ravkin | |
| 6,493,896 | B1 | 12/2002 | Stuchlik et al. | |
| 6,575,177 | B1 | 6/2003 | Brown et al. | |
| RE38,228 | E | 8/2003 | Hirose et al. | |
| 6,607,426 | B2 | 8/2003 | Suzuki | |
| 6,623,334 | B1 | 9/2003 | Birang et al. | |
| 6,676,493 | B1 | 1/2004 | Owczarz et al. | |
| 6,739,013 | B2 | 5/2004 | Glashauser et al. | |
| 6,749,494 | B2 * | 6/2004 | Mandall | 451/444 |
| 6,887,129 | B2 | 5/2005 | Birang | |
| 6,887,138 | B2 * | 5/2005 | Bottema et al. | 451/72 |
| 6,896,583 | B2 | 5/2005 | Rodriquez et al. | |
| 6,902,470 | B2 | 6/2005 | Cron | |
| 6,905,400 | B2 | 6/2005 | Kimura et al. | |
| 6,918,864 | B1 | 7/2005 | Brown et al. | |
| 6,935,938 | B1 | 8/2005 | Gotkis et al. | |
| 6,986,185 | B2 | 1/2006 | Sugarman et al. | |
| 6,994,612 | B2 | 2/2006 | Cron | |
| 7,037,178 | B2 | 5/2006 | Cron | |
| 7,229,504 | B2 | 6/2007 | Sugarman et al. | |
| 7,377,002 | B2 | 5/2008 | Yudovsky et al. | |
| 7,507,296 | B2 | 3/2009 | Sugarman | |
| 2001/0001886 | A1 | 5/2001 | Ueki et al. | |
| 2002/0005212 | A1 | 1/2002 | Beardsley et al. | |
| 2002/0116773 | A1 | 8/2002 | Anderson | |
| 2002/0139393 | A1 | 10/2002 | Crevasse et al. | |
| 2002/0173233 | A1 | 11/2002 | Griffin et al. | |
| 2003/0000550 | A1 | 1/2003 | Middendorf et al. | |
| 2003/0131872 | A1 | 7/2003 | Nishihara | |
| 2003/0153252 | A1 * | 8/2003 | Cron | 451/56 |
| 2003/0166383 | A1 * | 9/2003 | Kimura et al. | 451/56 |
| 2004/0097176 | A1 * | 5/2004 | Cron | 451/56 |
| 2004/0259487 | A1 * | 12/2004 | Bottema et al. | 451/444 |
| 2005/0109373 | A1 | 5/2005 | Brown et al. | |
| 2005/0221731 | A1 | 10/2005 | Charatan | |
| 2006/0189465 | A1 | 8/2006 | Brown et al. | |
| 2006/0205324 | A1 | 9/2006 | Mayes | |
| 2007/0212983 | A1 | 9/2007 | Nangoy et al. | |
| 2008/0210258 | A1 | 9/2008 | Yudovsky et al. | |
| 2009/0036035 | A1 | 2/2009 | Nangoy et al. | |
| 2009/0036036 | A1 | 2/2009 | Nangoy et al. | |

FOREIGN PATENT DOCUMENTS

| | | |
|---|---|---|
| GB | 2 276 537 | 10/1994 |
| JP | 02-303580 | 12/1990 |
| JP | 03-313421 | 11/1991 |
| JP | 05-129260 | 5/1993 |

OTHER PUBLICATIONS

Mar. 16, 2010 Response to Final Office Action of U.S. Appl. No. 12/245,759 Mailed Nov. 16, 2009.
Mar. 19, 2010 Response to Office Action of U.S. Appl. No. 11/684,969 Mailed Dec. 17, 2009.
Advisory Action of U.S. Appl. No. 12/245,759 Mailed Mar. 24, 2010.
Apr. 16, 2010 Response to Final Office Action of U.S. Appl. No. 12/245,758 Mailed Feb. 16, 2010.
U.S. Appl. No. 11/028,929, filed Jan. 4, 2005.
U.S. Appl. No. 11/413,257, filed Apr. 28, 2006.
Office Action of U.S. Appl. No. 11/684,969 Mailed Aug. 22, 2008.
Feb. 12, 2009 Response to Office Action of U.S. Appl. No. 11/684,969 Mailed Aug. 22, 2008.
Final Office Action of U.S. Appl. No. 11/684,969 Mailed May 14, 2009.
Aug. 15, 2009 Response to Final Office Action of U.S. Appl. No. 11/684,969 Mailed May 14, 2009.
Advisory Action of U.S. Appl. No. 11/684,969 Mailed Sep. 3, 2009.
Office Action of U.S. Appl. No. 12/245,758 Mailed Aug. 27, 2009.
Office Action of U.S. Appl. No. 12/245,759 Mailed Mar. 10, 2009.
Sep. 8, 2009 Response to Office Action of U.S. Appl. No. 12/245,759 Mailed Mar. 10, 2009.
Final Office Action of U.S. Appl. No. 12/245,759 Mailed Nov. 16, 2009.
Nov. 27, 2009 Response to Office Action of U.S. Appl. No. 12/245,758 Mailed Aug. 27, 2009.
Office Action of U.S. Appl. No. 11/684,969 Mailed Dec. 17, 2009.
Examiner Interview Summary of U.S. Appl. No. 11/684,969 Mailed Jul. 16, 2010.
Interview Summary of U.S. Appl. No. 11/684,969, filed Jul. 20, 2010.
Restriction Requirement of U.S. Appl. No. 11/684,969 mailed May 14, 2008.
Jun. 16, 2008 Response to Restriction Requirement of U.S. Appl. No. 11/684,969 mailed May 14, 2008.
Examiner Interview Summary of U.S. Appl. No. 11/684,969 mailed Aug. 13, 2009.
Interview Summary of U.S. Appl. No. 11/684,969, filed Aug. 15, 2009.
Restriction Requirement of U.S. Appl. No. 12/245,758 mailed Apr. 6, 2009.
Jun. 3, 2009 Response to Restriction Requirement of U.S. Appl. No. 12/245,758 mailed Apr. 6, 2009.
Interview Summary of U.S. Appl. No. 12/245,759, filed Mar. 16, 2010.
Examiner Interview Summary of U.S. Appl. No. 12/245,759 mailed Mar. 22, 2010.
Interview Summary of U.S. Appl. No. 12/245,758 mailed Jul. 30, 2010.
Notice of Abandonment of U.S. Appl. No. 12/245,758 mailed Aug. 25, 2010.
Final Office Action of U.S. Appl. No. 11/684,969 Mailed Jun. 14, 2010.
Advisory Action of U.S. Appl. No. 12/245,758 Mailed Jun. 28, 2010.
Office Action of U.S. Appl. No. 12/245,759 Mailed Jul. 1, 2010.
Sep. 22, 2010 Response to Office Action of U.S. Appl. No. 12/245,759 mailed Jul. 1, 2010.
Notice of Abandonment of U.S. Appl. No. 11/684,969 mailed Dec. 21, 2010.
Final Office Action of U.S. Appl. No. 12/245,759 Mailed Oct. 19, 2010.

* cited by examiner

APPARATUS AND METHODS FOR CONDITIONING A POLISHING PAD

This application is a division of, and claims priority to, U.S. Non-Provisional patent application Ser. No. 12/245,758, filed Oct. 5, 2008, and titled "APPARATUS AND METHODS FOR CONDITIONING A POLISHING PAD", which is a division of, and claims priority to, U.S. Non-Provisional patent application Ser. No. 11/684,969, filed Mar. 12, 2007, and titled, "APPARATUS AND METHODS FOR CONDITIONING A POLISHING PAD", which claims priority to U.S. Provisional Patent Application Ser. No. 60/782,133, filed Mar. 13, 2006, and titled, "APPARATUS AND METHODS FOR CONDITIONING A POLISHING PAD". Each of these patent applications is hereby incorporated by reference herein in their entirety for all purposes.

FIELD OF THE INVENTION

The present invention relates generally to electronic (e.g., semiconductor) device manufacturing and more particularly to apparatus and methods for conditioning a polishing pad.

BACKGROUND OF THE INVENTION

During conventional substrate processing, layers of material are formed on top of each other. Such layers may have surface undulations. As a result, layers being formed may be deformed by a previously formed layer. To reduce this effect, conventional semiconductor processes may employ a polishing process such as chemical mechanical polishing (CMP) or another suitable method. Such methods may employ a polishing pad to remove a portion of the layer so as to reduce the undulations.

The polishing process may employ, in addition to the polishing pad, a mixture of abrasive particles and fluid (e.g., slurry). The abrasive particles and the material being removed from the layer may become embedded in the polishing pad. Such embedded material may dislodge from the polishing pad and scratch the wafer. To remove such undesirable material, a conditioning disk may be employed. The conditioning disk may rotate while pressing the polishing pad with a force. However, the conditioning disk may apply a force and rotate at a speed that may not be controlled or well known. Thus, such a conditioning disk may not optimally remove a portion of the embedded material, thereby reducing the useful life of the polishing pad. Accordingly, there is a need to control the force and rotation of the conditioner pad.

SUMMARY OF THE INVENTION

In a first aspect of the invention, an apparatus for conditioning a polishing pad comprises an arm adapted to support a conditioning disk, a drive mechanism coupled to the arm, and a flexible coupling between the drive mechanism and the conditioning disk adapted to allow the conditioning disk to tilt while transmitting rotary motion from the drive mechanism to the conditioning disk.

Other features and aspects of the present invention will become more fully apparent from the following detailed description, the appended claims and the accompanying drawings.

DETAILED DESCRIPTION OF THE DRAWINGS

Figure 1:
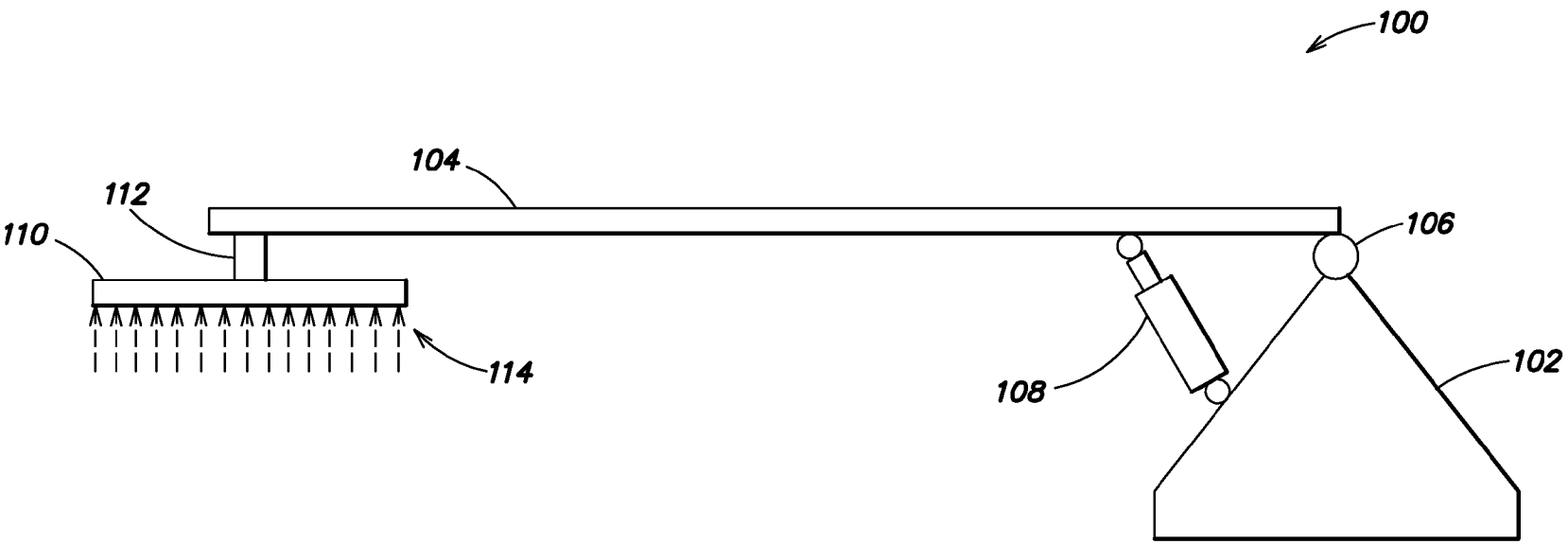
FIG. 1 is a schematic drawing of an example of a leverage arm design apparatus for conditioning a surface of a polishing pad according to some embodiments of the present invention.

The present invention provides improved apparatus and methods for conditioning a polishing pad. More specifically, the present invention provides an apparatus and methods for controlling a conditioning disk while it is pressing on a polishing pad. The present invention includes a polishing pad conditioner. The polishing pad conditioner may include an arm, a base, a load cell, a direct drive motor and a gimbal. The polishing pad conditioner may be coupled to a conditioning disk.

In an embodiment, the polishing pad conditioner includes a leverage arm design. In the leverage arm design, the arm may be pivotally coupled to the base. The actuator and conditioning disk may be coupled such that the conditioning disk is further from the pivot than the actuator. The actuator may be coupled to the arm and adapted to apply a force between the arm and base. Since the conditioning disk is further away from the pivot than the actuator, the arm effectively reduces the actuator force to a smaller conditioning disk force in proportion to the length of the arm. Thus, the leverage arm design may reduce the actuator force, and any fluctuations in the actuator force, to a smaller conditioning disk force. Since an increase in the actuator force may not have a corresponding increase in fluctuations, the leverage arm design effectively increases the conditioning disk force to variation ratio. Accordingly, there is an improvement in the control of the conditioning disk force, thereby improving control over the removal of the embedded material. In this manner, the useful life of the polishing pad may be extended.

The polishing pad conditioner may also include a force sensor. The force sensor may measure and provide a signal indicative of the conditioning disk force. In an embodiment, the sensor may be coupled between the actuator and base. In an alternative embodiment, the sensor may be coupled between the actuator and the arm. The force sensor may measure the actuator force. As described above, the actuator force is linearly related to the sensor force in proportion to the length of the arm. Thus, the sensor may provide a signal indicative of the conditioning disk force even though it may be coupled to the actuator. The signal may be fed to a controller that is adapted to control the force applied by the actuator. By employing such a sensor, a desired quantity of conditioning disk force may be applied by the controller by applying a corresponding quantity of actuator force. Thereby, the force sensor may allow for more optimal control of the removal of the embedded material. In this manner, the useful life of the polishing pad may be extended.

The invention also provides a direct drive motor to rotate the conditioning disk. Conventional motors, not having a direct drive, may require a transmission system to rotate the conditioning disk. Such transmission systems may have piece parts with mechanical tolerances that cause a slack between the conventional motor and the rotation of the conditioning disk. The slack in the transmission system may cause undesirable variations (e.g., backlash, vibrations, and/or the like) in the rotation of the conditioning disk. By employing a direct drive motor, the transmission system and the associated slack, may be eliminated. Thus, undesirable variation in the conditioning disk rotation may be reduced or eliminated, thereby allowing for greater control over the rotation of the conditioning disk. In this manner, the useful life of the polishing pad may also be extended. However, in some embodiments, a direct drive motor coupled to a planetary gear may provide a suitable degree of control over the rotation of the conditioning disk.

The invention also provides a gimbal. The gimbal may be a flexible material such as plastic. The gimbal may be employed to transmit rotation from the direct drive motor to the conditioning disk. The gimbal may be flexible so as to allow tilting while transmitting the rotation. Concurrently, the conditioning disk may apply a pressure to the polishing pad. The flexibility to tilt while applying the pressure allows the pressure to be more uniform. This may allow more uniform removal of the embedded material. In this manner, the useful life of the polishing pad may be further extended.

FIG. 1 is a schematic drawing of a leverage arm design apparatus for conditioning a surface of a polishing pad by pressing and rotating a conditioning disk on the surface of the polishing pad in accordance with an embodiment of the present invention. The leverage arm design apparatus 100 may include a base 102 and an arm 104. The base 102 may be coupled to the arm 104 via a pivot 106. The apparatus may also include an actuator 108 coupled to the base 102 and the arm 104. A conditioning disk 110 may be coupled to the arm 104 via a rotatable member 112. The rotatable member 112 may be rotatively coupled to the arm 104.

The base 102 may be stationary with respect to the arm 104. For example, the base 102 may be attached to semiconductor equipment such as a CMP or other suitable equipment. Alternatively, the base 102 may be coupled to facilities supporting semiconductor manufacturing such as a wall, building structure and/or the like. As another alternative, the base 102 may rotate about a vertical axis. A motor not shown may enable the base 102 to rotate about the vertical axis. The motor may connect the base 102 to the semiconductor equipment, the other equipment, the facilities supporting semiconductor manufacturing, etc. The motor may be a direct drive motor or other suitable motor. In addition, the motor may be connected to the base 102 via a suitable transmission mechanism, such as a lead screw or zero backlash harmonic gear.

The arm 104 may freely rotate about the pivot 106 in all directions. In an alternative embodiment, the arm 104 may be free to rotate about the pivot 106 only in the plane formed by the arm 104 and the actuator 108. In either embodiment, the actuator 108 may apply a force to the base 102 and the arm 104 so as to rotate the arm 104, relative to the base 102, about the pivot 106. In addition to applying the force, the actuator 108 may expand or contract axially, thereby allowing for rotation of the arm 104 relative to the base 102 while still being coupled to the base 102 and the arm 104. More than one actuator 108 may be employed although only one actuator is depicted in FIG. 1.

The conditioning disk 110 may rotate relative to the arm 104. The rotation of the conditioning disk 110 may be imparted to the conditioning disk 110 by the rotatable member 112. The rotation of the conditioning disk 110 may be in either direction and may be employed to condition a surface of a polishing pad. In addition, the rotation of the rotatable member 112 may be approximately the same as the rotation of the conditioning disk 110 although other suitable rotation ratios may be employed. The rotation of the conditioning disk 110 may be employed along with a pressure to condition the polishing pad.

To create the pressure, the arm 104 may be employed to press the conditioning disk 110 against the polishing pad. The force employed by the arm 104 to press the conditioning disk 110 against the polishing pad may be applied to the arm by the actuator 108 and/or other sources (e.g., weight of the arm and conditioning disk, friction and/or the like). The forces applied to the arm may form torques about the pivot 106. The forces applied to the arm may also include a polishing pad force. The polishing pad force is applied to the arm by a polishing pad pressure 114. The polishing pad pressure 114 may be applied by the polishing pad to the conditioning disk 110 when the arm presses the conditioning disk 110 to the polishing pad.

Because the arm 104 may rotate about the pivot 106, the polishing pad pressure 114 may be controlled by the actuator 108. The polishing pad force imparted on the arm by the polishing pad pressure 114 may be proportional to an actuator force applied by the actuator 108 to the arm 104. The polishing pad force 202 (see FIG. 2) is described in more detail below and may be in the range of about 0 to about 14 lbs. The actuator force and the polishing pad force may be linearly proportional. The actuator force and the polishing pad force may be proportional to the ratio between the distance between the pivot 106 and the actuator force and distance between the pivot 106 and the polishing pad force, as explained below with reference to FIG. 2.

Figure 2:
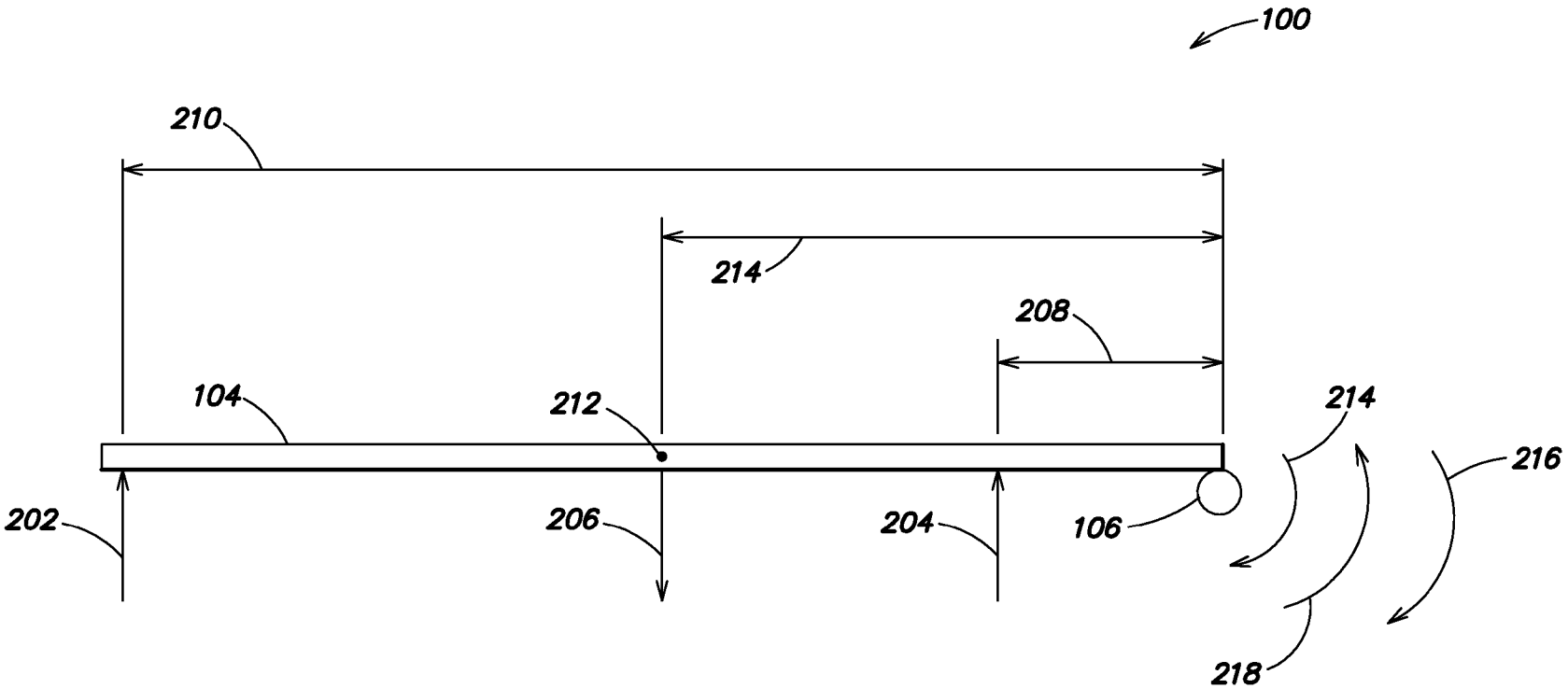
FIG. 2 is a schematic view depicting an example of a leverage arm design that employs a leverage arm ratio to relate the forces applied to the arm in accordance with some embodiments of the present invention.

FIG. 2 is a schematic view depicting a leverage arm design that employs a leverage arm ratio to relate the forces applied to the arm in accordance with an embodiment of the present invention. As discussed above with reference to FIG. 1 and depicted in FIG. 2, a polishing pad force 202, an actuator force 204 and an arm weight 206 may be applied to the arm 104. As discussed above in reference to FIG. 1, the arm 104 may be pivotally coupled to the pivot 106 as depicted in FIG. 2. The actuator force 204 may be located at an actuator force distance 208 from the pivot 106. The polishing pad force 202 may be located at a polishing pad force distance 210 from the pivot 106. The location of the center of gravity 212 of the arm 104 may be a weight distance 214 from the pivot 106. The weight 206 of the arm 104 may vary as a function of, inter alia, the material and gauge of material used to construct it. The arm weight 206 may approximately traverse the center of gravity 212 of the arm 104. Due to the distances, the forces applied to the arm may effectively create torques about the pivot 106.

Because the arm 104 may rotate about the pivot 106, the polishing pad force 202, the actuator force 204 and the arm weight 206 may form torques about the pivot 106. An actuator torque 214 due to the actuator force 204 may be approximately equal to the actuator force 204 multiplied by an actuator force distance 208. A polishing pad torque 216 may be approximately equal to the polishing pad force 202 multiplied by the polishing pad force distance 210. A weight torque 218 may be approximately equal to the arm weight 206 multiplied by the arm weight distance 214.

The arm weight 206 may pull the arm 104 in a downward direction (the direction of the force of gravity) while the polishing pad force 202 presses approximately upward on the arm 104. The actuator force 204 may be in the approximately upward or approximately downward direction although it is depicted in the approximately upward direction in FIG. 2. Thus, to reduce the polishing pad force 202, the actuator force 204 may be applied in the approximately upward direction. To increase the polishing pad force 202 the actuator force 204 may be applied in the approximately downward direction. The relationship between a quantity of actuator force 204 and a quantity of the polishing pad force 202 may be proportional to a leverage ratio of the distances of the forces.

The leverage ratio of the leverage arm design may be a ratio of the distance between two or more forces being applied to the arm 104. Specifically, the polishing pad force 202 may be proportional to the leverage ratio of the polishing pad force distance 210 to the actuator force distance 208. Thus, if the actuator force distance 208 is smaller than the polishing pad force distance 210, the polishing pad force 202 may be smaller than the actuator force 204. For example, the leverage ratio of the polishing pad force distance 210 to actuator force distance 208 may be about 10 to about 1. In this example, and when the arm 104 is stationary, the actuator force 204 may be approximately ten times larger than the polishing pad force 202 although the actuator force 204 may be greater or smaller depending on the arm weight 206. Thus, the leverage arm design may reduce the actuator force 204 to a polishing pad force 202.

Reducing the actuator force 204 to a smaller polishing pad force 202 with the leverage arm design may be desired. An increase in the actuator force 204 may not have a corresponding increase in variation in the actuator force. Also, an increase in the actuator force 204 may not increase variations of other forces applied to the arm 104 near the actuator 108. By reducing the actuator force 204 to a smaller polishing pad force 202 using the leverage ratio, the actuator force 204 may be increased to impart a desired polishing pad force 208. In this manner, variations associated with the actuator 108 and/or other forces applied to the arm 104 may be reduced. Thus, the leverage ratio of the leverage arm design may improve the force to variation ratio, thereby improving the control over the polishing pad pressure.

In addition, the reduction in the actuator force 204 to the polishing pad force 202 may allow for greater selection in the actuator. For example, an actuator that applies a force range of about 5 lbs to about 50 lbs may be employed in a leverage arm design apparatus 100 that applies a polishing pad force 202 of about 0.5 lbs to about 5 lbs. Some applications of the leverage arm design apparatus 100 may preferably employ such force ranges. However, relatively inexpensive actuators able to apply a force range of about 0.5 lbs to about 5 lbs may not be available or may be prohibitively expensive. Thus, the leverage arm design may allow for a reduction in material costs of the leverage arm design apparatus 100 and/or employment of the leverage arm design apparatus 100 in low down force applications.

Figure 3A:
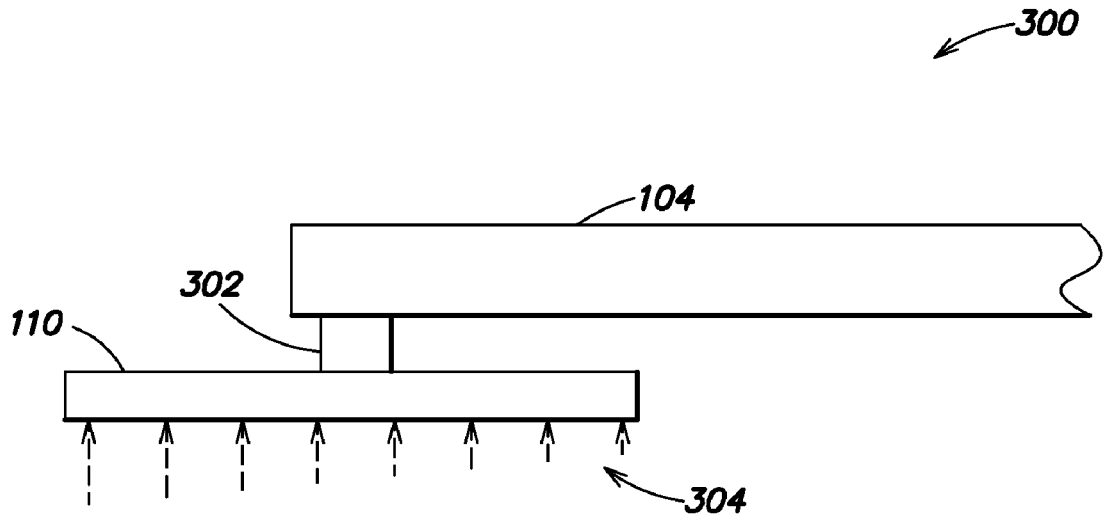
FIGS. 3A and 3B are schematic views depicting a conditioning disk coupled to an example of a leverage arm design via a flexible rotatable member in accordance with some embodiments of the present invention.
Figure 3B:
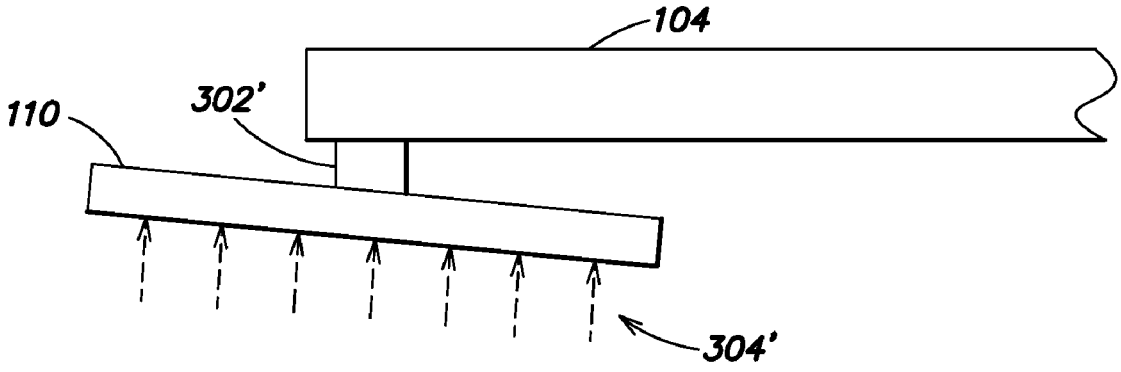

FIGS. 3A and 3B are schematic drawings depicting the conditioning disk coupled to the arm via a flexible rotatable member in accordance an embodiment of the present invention. The polishing pad conditioner apparatus 300 may employ a leverage arm design similar to the leverage arm design apparatus 100 described with reference to FIGS. 1-2. The polishing pad conditioner apparatus 300 depicted in FIG. 3 may include the arm 104 coupled to the conditioning disk 110 via a flexible rotatable member 302.

The flexible rotatable member 302 may be adapted to impart a rotation to the conditioning disk 110 such that the conditioning disk 110 rotates relative to the arm 104. Further, the flexible rotatable member 302 may also be adapted to flex when a non-uniform polishing pad pressure 304 is applied to the conditioning disk 110. The non-uniform polishing pad pressure 304 may be due to a surface of the conditioning disk 110 and a surface of the polishing pad not being coplanar or other reasons. The non-uniform polishing pad pressure 304 may also be due to other imperfections such as surface undulations of the polishing pad. The conditioning disk 110 may tilt so as to allow the non-uniform polishing pad pressure 304 to change into a more uniform polishing pad pressure 304'. The more uniform polishing pad pressure 304' is not necessarily perfectly uniform. A flexed flexible member 302' may allow some non-uniformity to be present in the more uniform polishing pad pressure 304'.

The flexible rotatable member 302 may include one or more portions. For example, the flexible rotatable member 302 may include an approximately rigid shaft coupled to a flexible coupler (e.g., gimbal, rubber, etc.). The flexible coupler may be coupled between the shaft and the conditioning disk 110. Conversely, the flexible coupler may be coupled between the shaft and the arm. The flexible rotatable member 302 may also be a single flexible member that is able to flex when a non-uniform polishing pad pressure 304 is applied to the conditioning disk 110.

Figure 4:
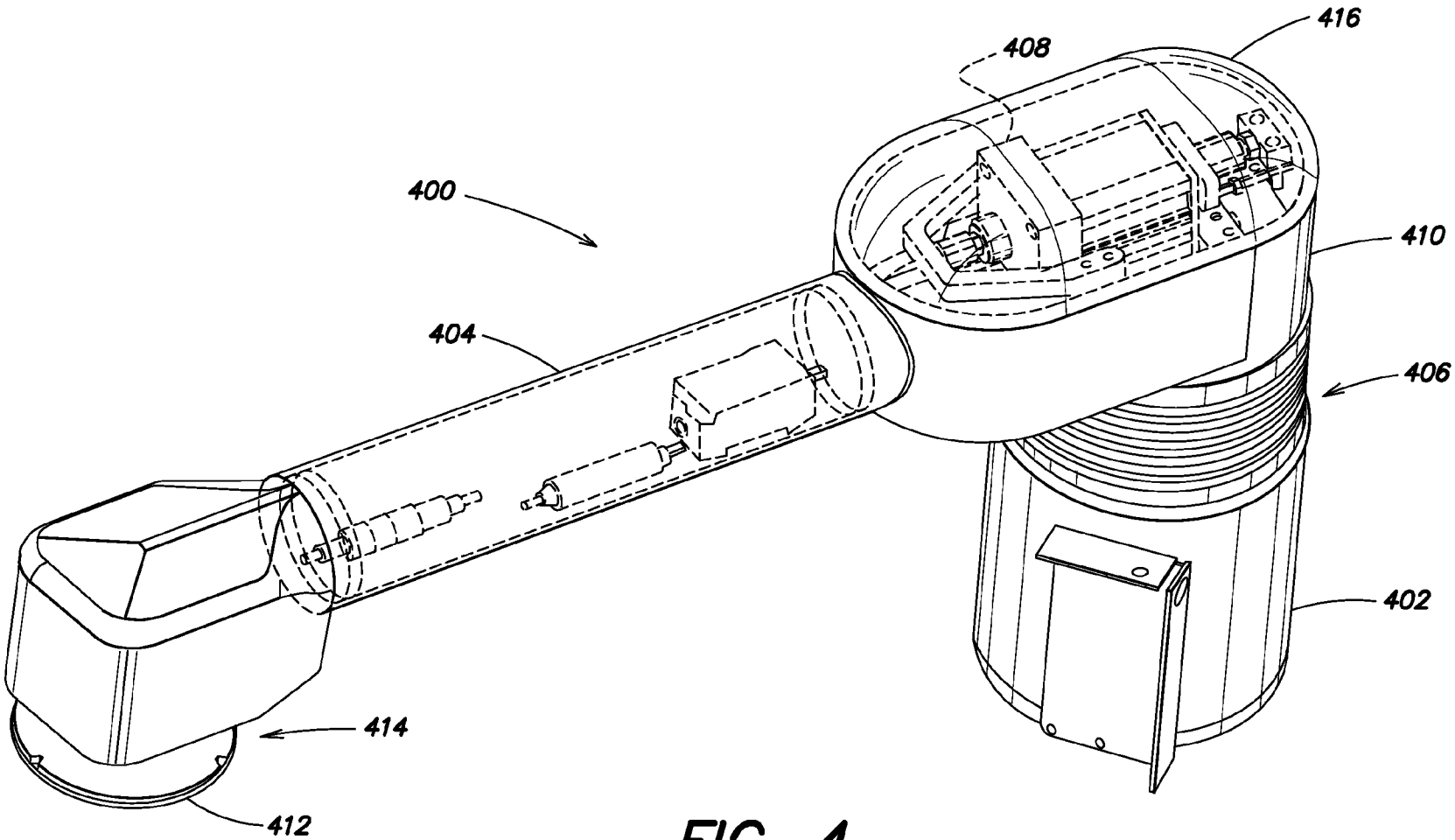
FIG. 4 is a perspective view of an example pad conditioner apparatus having an applied leverage arm design in accordance with some embodiments of the present invention.

FIG. 4 is a perspective drawing of a pad conditioner apparatus having an applied leverage arm design in accordance with an embodiment of the present invention. The pad conditioner apparatus 400 may have a cylindrical base 402. The cylindrical base 402 may be pivotally coupled to a tubular arm 404 via a housed pivot 406. A pneumatic actuator 408 may be coupled to the cylindrical base 402 and the tubular arm 404. The pneumatic actuator 408 may be coupled to the tubular arm 404 via an actuator housing 410. The tubular arm 404 may be coupled to a rotatable conditioning disk 412 via a rotatively driven member 414. The pad conditioner apparatus 400 may also include a rounded actuator cover 416 coupled to the actuator housing 410. In some embodiments of the present invention, a pad conditioner apparatus 400 and associated components may be made from various different materials including aluminum, stainless steel, carbon steel, polyvinyl chloride (PVC), polyethylene terephthalate (PET), etc.

In operation, the pad conditioner apparatus 400 may employ a leverage arm design that may be similar to the leverage arm design apparatus 100 employing the leverage ratio described with reference to FIGS. 1 and 2. The pneumatic actuator 408 may apply a pneumatic actuator force to the actuator housing 410. A weight of the tubular arm 404 and/or the pneumatic actuator force may be employed to press the rotatable conditioning disk 412 into the polishing pad with a rotatable conditioning disk force. The pneumatic actuator force may be linearly proportional to a polishing pad force due to the applied leverage arm design. Further, the rotatable conditioning disk 412 may rotate while pressed into the polishing pad.

In an embodiment, the tubular arm 404 may have a portion without welds and/or seals. By employing such a portion, the tubular arm 404 may provide an improved seal to shield an internal region of the tubular arm 404 from contaminants such as slurry and/or other matter. Shielding the internal region of the tubular arm 404 may be desired so as to ensure that components such as sensors, motors and/or the like are not undesirably contaminated. In addition, the rounded top surface of the tubular arm 404 may employ gravity to remove a portion of contaminants that may be present on a surface of the tubular arm 404. Such contamination may undesirably affect the performance of the components employed by the pad conditioner apparatus 400.

To further address possible contamination, the pad conditioner apparatus 400 may also include a rounded actuator cover 416. The rounded actuator cover 416 may allow portions of the contamination on a surface of the rounded actuator cover 416 to slide off the surface. Thus, the contamination may not accumulate on the surface of the rounded actuator cover 416. This may be desired to reduce the possibility of contamination of the components of the pad conditioner apparatus 400.

In some embodiments, the rotatable conditioning disk 412 may be allowed to tilt. The rotatively driven member 414 may be coupled to a flexible mechanism similar to the flexible rotatable member 302 described with reference to FIG. 3. An embodiment that allows the conditioning disk 412 to tilt is described in more detail below with reference to FIG. 5.

Figure 5:
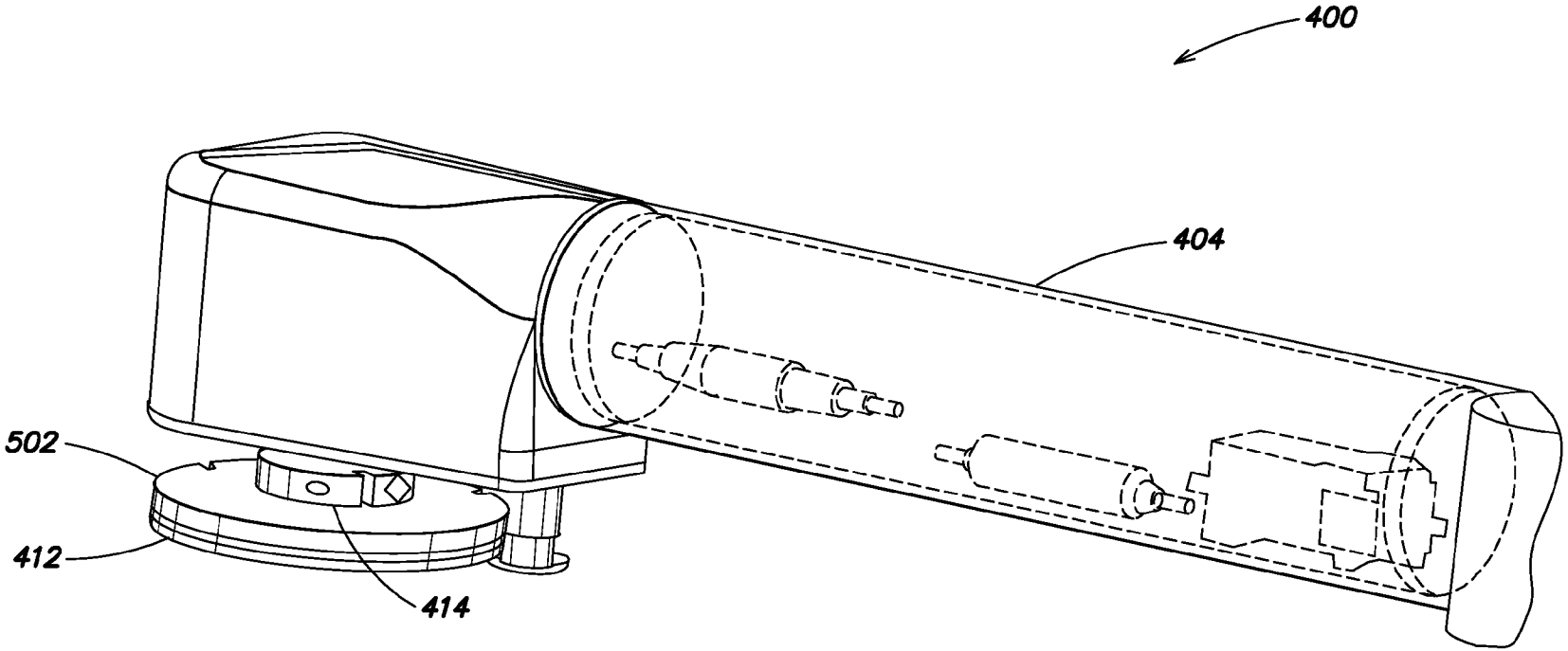
FIG. 5 is a detailed perspective view depicting a portion of an example pad conditioner apparatus in accordance with some embodiments of the present invention.

FIG. 5 is a detailed perspective drawing depicting a portion, including the rotatable conditioning disk, of the pad conditioner apparatus in accordance with an embodiment of the present invention. The pad conditioner apparatus 400 may include a rotatively driven member 414 as described above with reference to FIG. 4. The rotatively driven member 414 may be coupled to a rotatable conditioning disk 412 via a gimbal 502.

Figure 11:
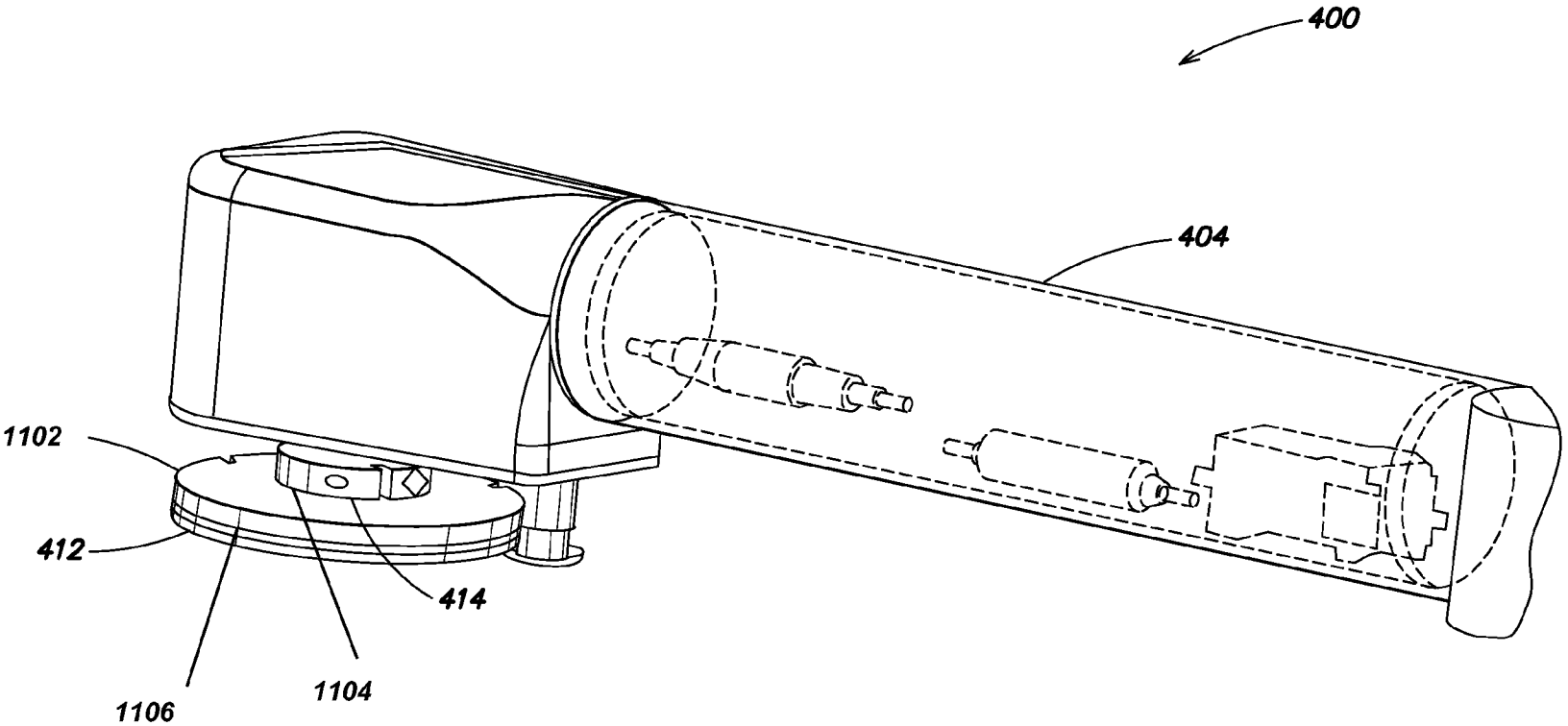
FIG. 11 is a detailed perspective view depicting a portion of another example pad conditioner apparatus in accordance with some embodiments of the present invention.

Still with reference to FIG. 5, the rotatively driven member 414 may impart a rotation to the rotatable conditioning disk 412 via the gimbal 502. The gimbal 502 may be adapted to move or flex so as to allow the rotatable conditioning disk 412 to tilt when a non-uniform pressure is applied to a surface of the rotatable conditioning disk 412. In some embodiments, in place of a gimbal 502, a flexible sheet or disk 1102 (FIG. 11) of material may be used. The flexible sheet or disk 1102 may include a central top attachment point 1104 that may be coupled to the rotatively driven member 414 and a lower peripheral surface 1106 that may be coupled to the rotatable conditioning disk 412. In alternative embodiments, the flexible sheet or disk 1102 may be inverted and attached to the rotatable conditioning disk 412 at the center 1104 and to the rotatively driven member 414 at the periphery 1106. Thus, the radial flexibility of the flexible sheet or disk 1102 may allow the rotatable conditioning disk 412 to tilt relative to the rotatively driven member 414. Therefore, similar to the polishing pad conditioner apparatus 300 described with reference to FIG. 3, the pressure applied to a surface of the rotatable conditioning disk 412 may become more uniform.

In some embodiments, the gimbal 502 may be replaced by alternative means of flexing. For example, the gimbal 502 may be a flexible joint coupled to the rotatively driven member 414 and the rotatable conditioning disk 412. In alternative embodiments, the flexible portion, similar to the flexible rotatable member 302 described in reference to FIG. 3, may be coupled to the tubular arm 404 and the rotatively driven member 414.

Returning to FIG. 4, the pad conditioner apparatus 400 may also include the pneumatic actuator 408. The pneumatic actuator 408 may include a metal seal pneumatic cylinder coupled to a rod. The rod may be coupled to the tubular arm 404. Although the pneumatic actuator 408 may be actuated by compressed air, any suitable means may be employed. For example, the pneumatic actuator 408 may be replaced by a hydraulic actuator motivated by hydraulic pressure. Alternatively, the pneumatic actuator 408 may be a stepper motor motivated by electrical power.

The rod may apply the pneumatic actuator force to the arm such that the pneumatic actuator force is linearly related to any displacement of the rod. As discussed above, the pneumatic actuator force may be employed to apply a rotatable conditioning disk force to the polishing pad. The linearly proportional pneumatic actuator force may be desired to ensure a more controllable rotatable conditioning disk force. For example, if the pneumatic actuator force is linearly proportional to the displacement of the rod, then it may be possible to correlate the rotatable conditioning disk force with the displacement of the rod. The manner in which the pneumatic actuator 408 may apply a force and be coupled to the tubular arm 404 and to the cylindrical base 402 is described in more detail below with reference to FIG. 6.

Figure 6:
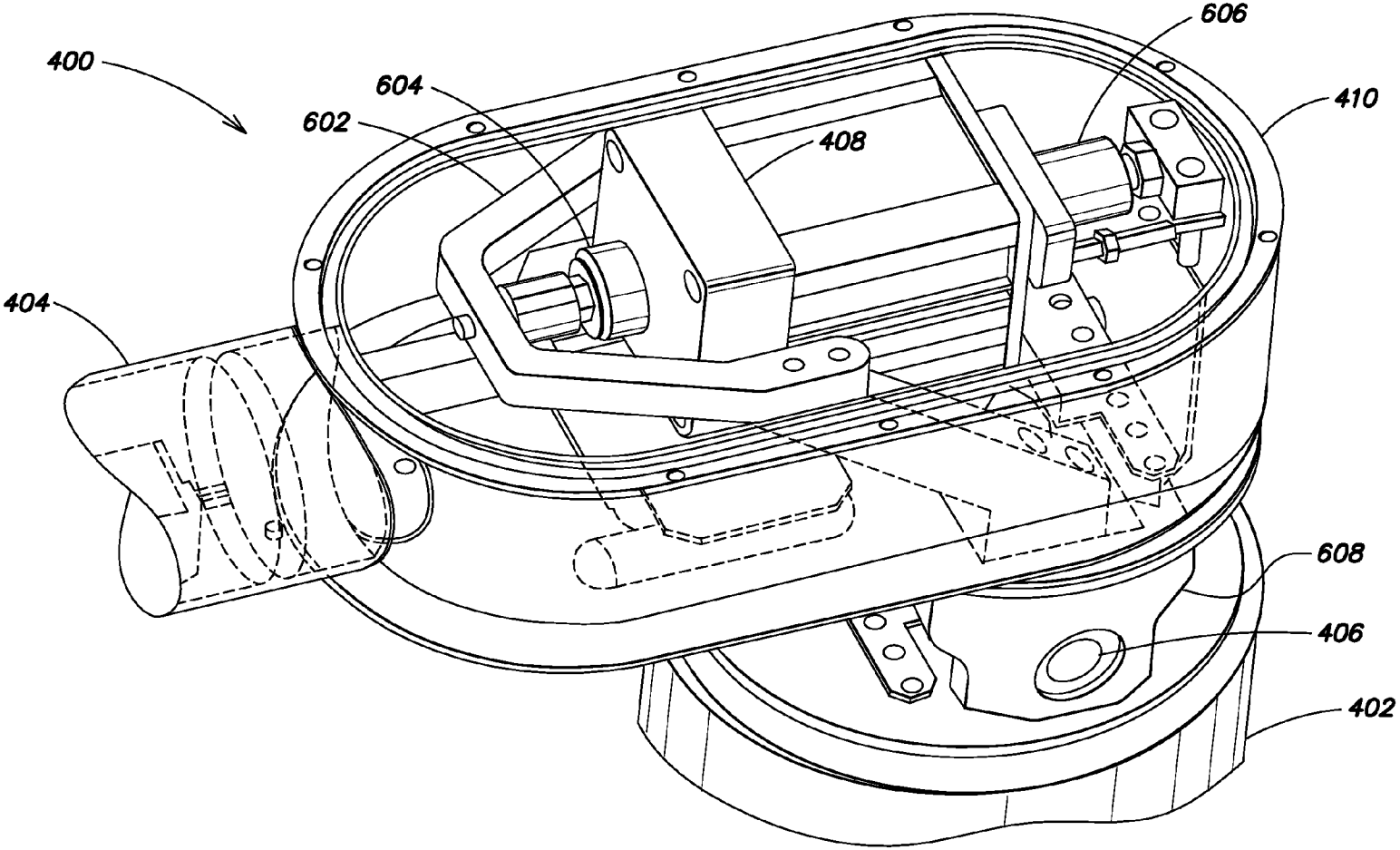
FIG. 6 is a detailed perspective view of a portion of an example pad conditioner apparatus including an applied leverage arm design in accordance with some embodiments of the present invention.

FIG. 6 is a detailed perspective drawing of a portion of the pad conditioner apparatus having an applied leverage arm design in accordance with an embodiment of the present invention. The pad conditioner apparatus 400 may include a base extension 602. The base extension 602 may be coupled to the cylindrical base 402. A base rod 604 may be coupled to the base extension 602 and the pneumatic actuator 408. An arm rod 606 may be coupled to the actuator housing 410. A pivot member 608 may be coupled to the housed pivot 406 and the actuator housing 410.

In operation, the pneumatic actuator 408 may apply a force to the base extension 602 via the base rod 604 and the actuator housing 410 via the arm rod 606. The force may cause the tubular arm 404, actuator housing 410 and pivot member 608 to pivot about the housed pivot 406. Thereby the force may be employed to apply a rotatable conditioning disk force to the polishing pad as described with reference to FIG. 4.

Figure 7:
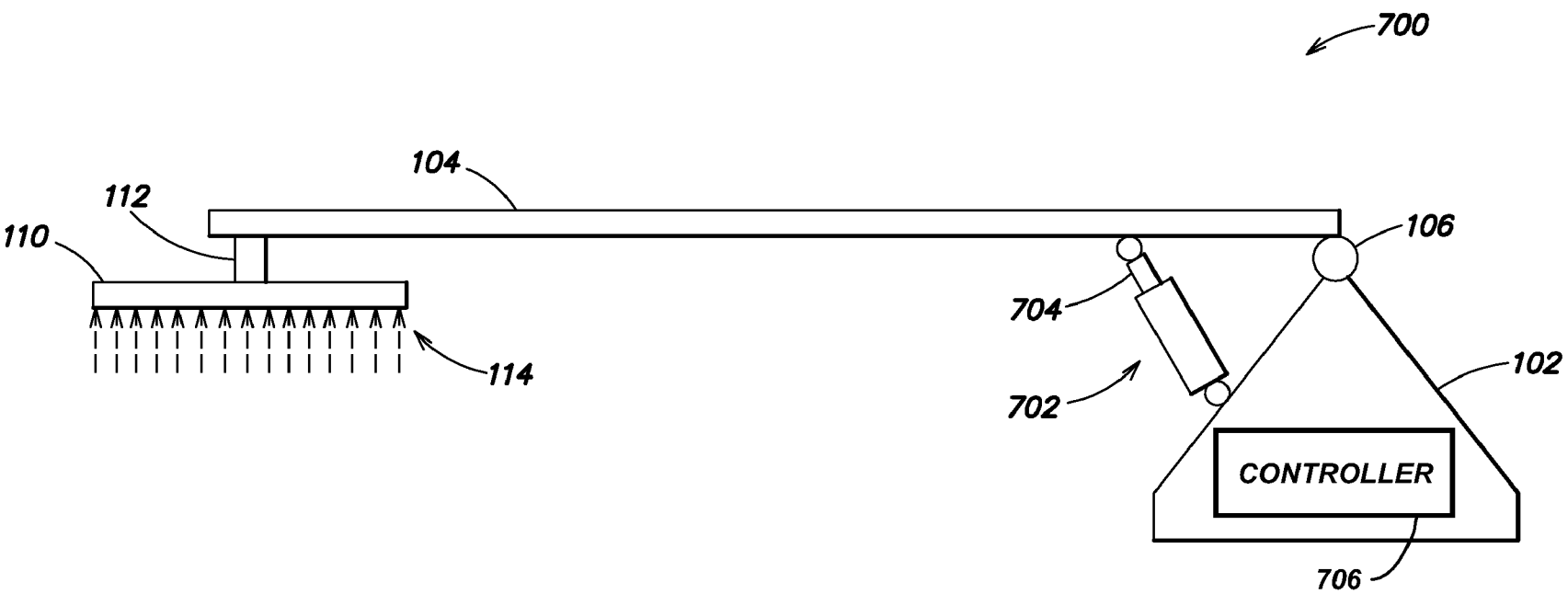
FIG. 7 is a schematic view of an example conditioner feedback apparatus in accordance with some embodiments of the present invention.

FIG. 7 is a schematic view of a conditioner feedback apparatus employed to press a conditioning disk into a polishing pad with an arm and an actuator, and provide a signal indicative of the force applied to the polishing pad, in accordance with an embodiment of the present invention. A conditioner feedback apparatus 700 may be similar to the leverage arm design apparatus 100 described with reference to FIG. 1. The polishing pad conditioner feedback apparatus 700 may have a feedback actuator 702 coupled to the arm 104 via a force transducer 704. The feedback actuator 702 may also be coupled to the base 102.

In a manner similar to the leverage arm design apparatus 100, the feedback actuator 702 may apply a force to the arm 104 via the force transducer 704. The force may be measured by the force transducer 704. The force transducer 704 may provide a signal to a controller 706 indicative of the force applied to the arm 104 by the feedback actuator 702. The signal indicative of the force applied to the arm 104 may be proportional to the force applied to the polishing pad by the conditioning disk 110 due to the leverage ratio as described with reference to FIGS. 1 and 2. The controller 706 may be coupled to the feedback actuator 702 to send a control signal to the feedback actuator 702 to adjust the force applied to the arm 104 in response to the signal from the force transducer 704.

In alternative embodiments, the force transducer 704 may be disposed in other suitable locations. For example, the force transducer 704 may be disposed between the feedback actuator 702 and the base 102. In yet another embodiment, the force transducer 704 may be coupled to the conditioning disk 110 so as to measure the polishing pad force directly. In such an embodiment, the leverage ratio may not be employed to determine the polishing pad force.

Figure 8:
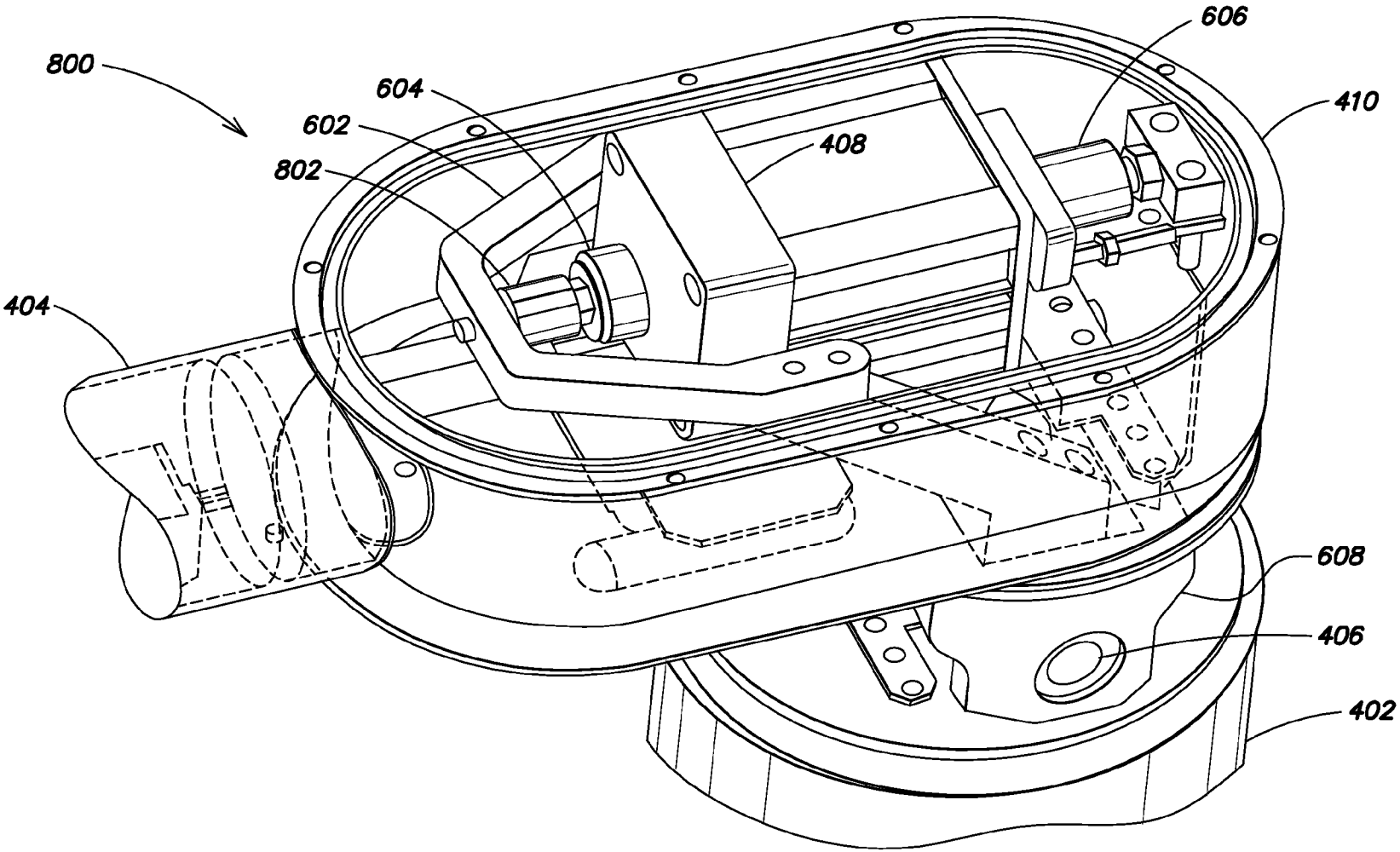
FIG. 8 is a detailed perspective view depicting an example pad conditioner feedback apparatus that employs a force transducer in accordance with some embodiments of the present invention.

FIG. 8 is a detailed perspective drawing depicting a pad conditioner feedback apparatus employing a force transducer in accordance with an embodiment of the present invention. The pad conditioner feedback apparatus 800 may be similar to the pad conditioner apparatus 400 described with reference to FIGS. 4-6 and the conditioner feedback apparatus 700 described with reference to FIG. 7. The pad conditioner feedback apparatus 800 may include a transducer 802. The transducer 802 may be physically coupled to the base rod 604 and the base extension 602 and electrically coupled to a controller.

Similar to the pad conditioner apparatus 400 described with reference to FIG. 6, the pneumatic actuator 410 may apply a force to the base extension 602. The transducer 802 may measure the force and provide a signal to a controller (not shown) indicative of the force. The transducer 802 may be, for example, a load cell strain gage manufactured by Measurement Specialties, Inc. of Hampton, Va. or Honeywell Sensing and Control of Golden Valley, Minn. A range of the force that the transducer may measure may be from about −150 lbs to about +150 lbs. The controller may use the signal to adjust the amount of force being applied by the pneumatic actuator 410.

Still with reference to FIG. 8, similar to the conditioner feedback apparatus 700 describe with reference to FIG. 7, the transducer 802 may be disposed in different locations. For example, the transducer 802 may be coupled to the arm rod 606. In such an embodiment, the transducer 802 may be disposed between the pneumatic actuator 410 and the arm rod 606. Alternatively, the transducer 802 may be disposed between the arm rod 606 and the actuator housing 410.

Figure 9:
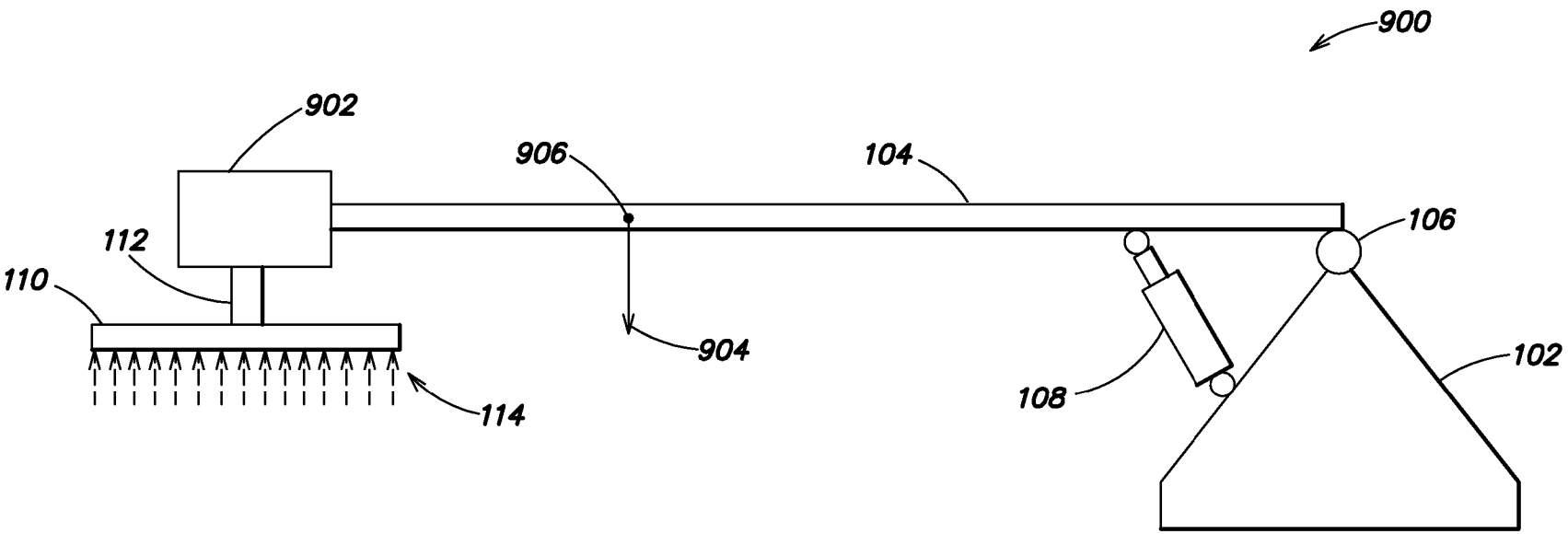
FIG. 9 is a schematic view of an example driven conditioning apparatus in accordance with some embodiments of the present invention.

FIG. 9 is a schematic drawing of a driven conditioning apparatus having a motor to rotate the conditioning disk in accordance with an embodiment of the present invention. The driven conditioning apparatus 900 may have a leverage design similar to embodiment 100. In addition, the driven conditioning apparatus 900 may include a driving mechanism 902. The driving mechanism 902 may be rotatively coupled to the conditioning disk 110 via the rotatable member 112. A weight of the driving mechanism 902 may be combined with the arm weight 206 such that a combined weight 904 may be formed. The combined weight 904 may be located at a combined center of gravity 906.

The driving mechanism 902 may be adapted to rotate the conditioning disk 110 via the rotatable member 112. The driving mechanism 902 may rotate the conditioning disk 110 while the conditioning disk 110 is pressing into a polishing pad. In some embodiments, a rotation frequency (e.g., revolutions per minute (rpm)) of a portion of the driving mechanism 902 may be approximately equal to a conditioning disk 110 rotation frequency. In the same or alternative embodiments, the rotation frequency of a portion of the driving mechanism 902 may be different than the conditioning disk 110 rotation frequency.

A weight of the driving mechanism 902 may be added to the arm weight 206. For example, the weight of the driving mechanism 902 may be added to the arm weight 206 to form an aggregate weight 904. The aggregate weight 904 may be different than the weight of the arm 104. In addition, the distance of the combined center of gravity 906 from the pivot 106 may be different than the center of gravity 212. Thus, the leverage ratio, discussed in detail with reference to FIG. 2, may be different when the driving mechanism 902 is coupled to the distal end of the arm 104. Specifically, the distance of the aggregate weight 904 from the pivot 106 may be greater than the weight distance 214 discussed with reference to FIG. 2. Consequently, the leverage ratio may be increased when the aggregate weight 904 is further from the pivot than the center of gravity 212.

The driving mechanism 902 may be a motor or another suitable driving mechanism. For example, the driving mechanism 902 may be an electrical motor. In alternative embodiments, the driving mechanism 902 may be a pneumatically driven motor. In further alternative embodiments, the driving mechanism may be a direct drive motor, which may be coupled to a planetary gear.

Figure 10:
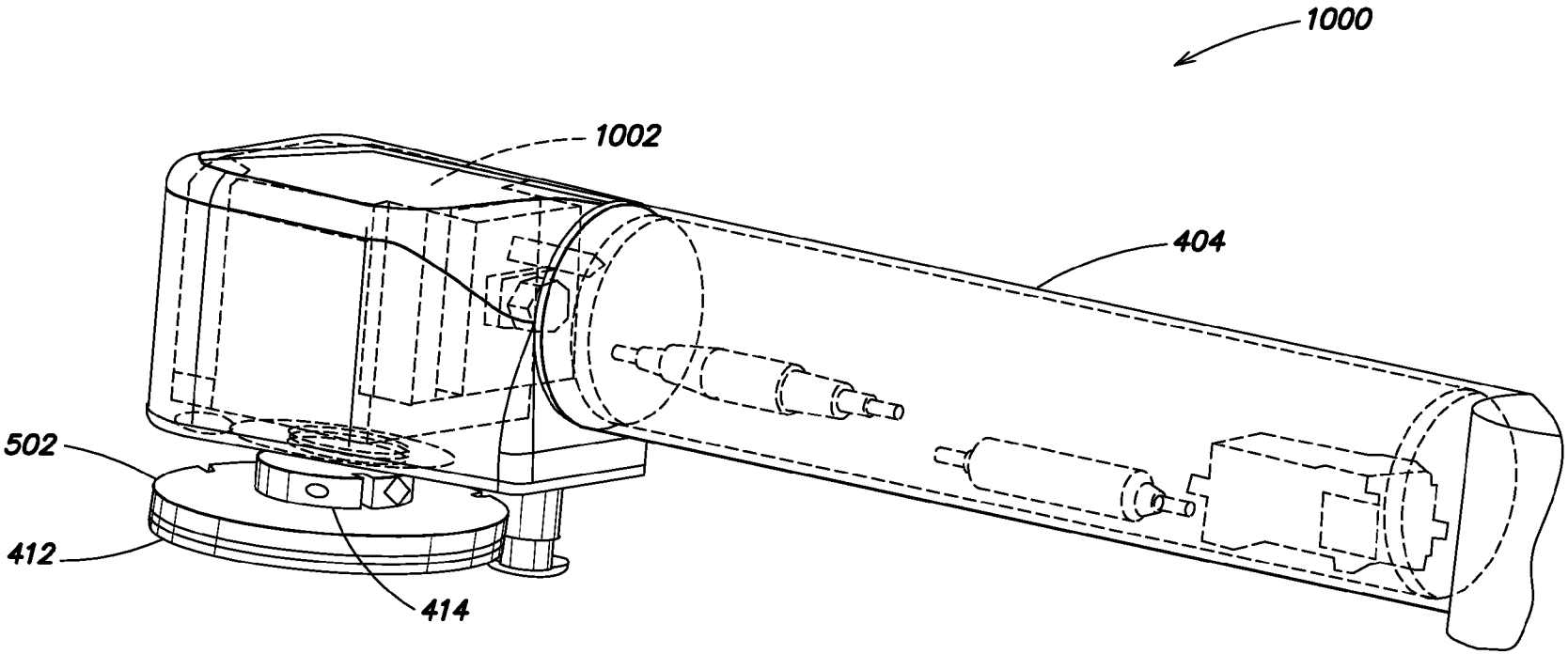
FIG. 10 is a detailed perspective view of a motor coupled to a rotatable conditioning disk and an arm in accordance with some embodiments of the present invention.

FIG. 10 is a detailed perspective drawing of a motor coupled to the rotatable conditioning disk and the tubular arm in accordance with an embodiment of the present invention. A motor 1002 may be coupled to the tubular arm 404 and the rotatively driven member 414. Similar to the pad conditioner apparatus 400 discussed with reference to FIGS. 4 and 5, the rotatively driven member 414 may be coupled to the rotatable conditioning disk 412 via the gimbal 502.

The motor 1002 may be a direct drive motor or another suitable motor. In other embodiments, the motor 1002 may be coupled to a planetary gear. The motor 1002 may be directly coupled to the rotatively driven member 414 so as to rotate the rotatable conditioning disk 412 at about the same rotation frequency as a rotatable portion of the motor 1002. In other embodiments, the motor 1002 may be coupled to the rotatable conditioning disk 412 such that the rotation frequency of the rotatable portion of the motor 1002 may be different than the rotation frequency of the rotatable conditioning disk 412.

The foregoing description discloses only exemplary embodiments of the invention. Modifications of the above disclosed apparatus and method which fall within the scope of the invention will be readily apparent to those of ordinary skill in the art. For instance, an actuator may be disposed in other locations relative to the base. The actuator may be coupled to the arm and something other than the base so as to apply a polishing pad pressure.

Accordingly, while the present invention has been disclosed in connection with exemplary embodiments thereof, it should be understood that other embodiments may fall within the spirit and scope of the invention, as defined by the following claims.

The invention claimed is:

1. An apparatus for conditioning a polishing pad comprising:

an arm adapted to support a conditioning disk;

a drive mechanism coupled to the arm;

a flexible coupling between the drive mechanism and the conditioning disk adapted to allow the conditioning disk to tilt while transmitting rotary motion from the drive mechanism to the conditioning disk, wherein the flexible coupling consists of a shaft and a flexible coupler adapted to couple to the conditioning disk; and wherein the tilt of the conditioning disk is constrained by the flexible coupling.

2. The apparatus of claim 1, wherein the flexible coupling includes a flexible disk.

3. The apparatus of claim 2, wherein the flexible disk is one piece.

4. The apparatus of claim 2, wherein the flexible disk is plastic.

5. The apparatus of claim 2, wherein the drive mechanism is coupled to a center portion of the flexible disk.

6. The apparatus of claim 2, wherein the conditioning disk is coupled to an outer portion of the flexible disk.

7. The apparatus of claim 2, wherein the drive mechanism is coupled to an outer portion of the flexible disk.

8. The apparatus of claim 2, wherein the conditioning disk is coupled to a center portion of the flexible disk.

9. A method for conditioning a polishing pad comprising:

providing a flexible coupling consisting of a shaft and a flexible coupler between an arm and a drive mechanism coupled to the arm, the flexible coupler adapted to couple to a conditioning disk;

supporting the conditioning disk with the arm;

tilting the conditioning disk; and transmitting rotary motion from the drive mechanism to the conditioning disk;

wherein the flexible coupling allows the conditioning disk to tilt while transmitting rotary motion from the drive mechanism to the conditioning disk; and wherein the tilt of the conditioning disk is constrained by the flexible coupling.

10. The method of claim 9 wherein the flexible coupling includes a flexible disk.

11. The method of claim 10 further comprising:

coupling the drive mechanism to a center portion of the flexible disk.

12. The method of claim 10 further comprising:

coupling the drive mechanism to an outer portion of the flexible disk.

13. The method of claim 10 further comprising:

coupling the conditioning disk to an outer portion of the flexible disk.

14. The method of claim 10 further comprising:

coupling the conditioning disk to a center portion of the flexible disk.

15. The method of claim 10 further comprising:

tilting the conditioning disk relative to the drive mechanism.

* * * * *